US007529513B2

(12) United States Patent
Kikuchi

(10) Patent No.: US 7,529,513 B2
(45) **Date of Patent: *May 5, 2009**

(54) FIXING APPARATUS

(75) Inventor: Kazuhiko Kikuchi, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/889,450

(22) Filed: Aug. 13, 2007

(65) Prior Publication Data

US 2007/0280716 A1 Dec. 6, 2007

Related U.S. Application Data

(63) Continuation of application No. 11/035,966, filed on Jan. 18, 2005, now Pat. No. 7,263,323.

(51) Int. Cl.
*G03G 15/20* (2006.01)

(52) U.S. Cl. ..... 399/327

(58) Field of Classification Search ..... 399/107, 399/122, 320, 327

See application file for complete search history.

(56) References Cited

U.S. PATENT DOCUMENTS 5,506,669 A 4/1996 Inoue et al.
5,907,348 A 5/1999 Ogasawara et al.
5,978,640 A 11/1999 Segawa
6,539,195 B2 * 3/2003 Sakaba et al. ..... 399/326
6,876,832 B2 4/2005 Pirwitz et al.
7,046,950 B2 5/2006 Fuma et al.
2006/0245778 A1 11/2006 Kachi

FOREIGN PATENT DOCUMENTS

JP 60-143374 * 7/1985
JP 4-22982 * 1/1992
JP 4-275584 A 10/1992
JP 6-19356 * 1/1994
JP 2000-181269 A 6/2000
JP 2000-214717 A 8/2000

* cited by examiner

*Primary Examiner*—Hoan H Tran
(74) *Attorney, Agent, or Firm*—Foley & Lardner LLP

(57) ABSTRACT

There is disclosed a fixing apparatus of the present invention, including a cleaning web 51, first and second take-up shafts 53, 54 which support opposite ends of the cleaning web, respectively, and a web pressing member 52 which presses the supported cleaning web 51 against a heating roller 1, and the web pressing member 52 presses the cleaning web 51 against the heating roller 1 in such a manner that a load applied to the heating roller on an upstream side in a rotation direction is larger than that on a downstream side.

21 Claims, 4 Drawing Sheets

FIXING APPARATUS

The present application is a continuation of U.S. application Ser. No. 11/035,966, filed Jan. 18, 2005, the entire contents of which are incorporated herein by reference.

BACKGROUND OF THE INVENTION

1. Field of the Invention

The present invention relates to a fixing apparatus which fixes a developer image on a sheet.

2. Description of the Related Art

An image forming apparatus utilizing a digital technique, for example, an electronic copying machine has a fixing apparatus which applies a pressure to a developer image molten by heating to fix the image on a sheet.

The fixing apparatus includes a heating member for melting a developer, for example, a toner; and a pressurizing member which supplies a predetermined pressure to the heating member, and a predetermined contact width (nip width) is formed in a contact region (nip portion) between the heating member and the pressurizing member. A developer image on the sheet, molten by heat from the heating member, is fixed to the sheet which passes through this nip portion by pressure from the pressurizing member.

Moreover, a cleaning device for removing attached matters attached to the surfaces of the members, offset toner, paper powder and the like is disposed around the heating member or the pressurizing member.

For example, a fibrous cleaning sheet is allowed to abut on the surface of the heating member, an equal load is applied to both contact faces, toner, paper powder and the like are attached to the cleaning sheet, and accordingly the heating member is cleaned. Moreover, there is a cleaning device in which the cleaning sheet of a dirty portion is taken up, and the cleaning sheet of a new portion is successively unwound/released and allowed to abut on the surface of the heating member. In this case, since the toner or the like is attached to the whole contact face of the cleaning sheet with the heating member, and recovered, the removed toner or the like uniformly sticks to the whole contact face of the cleaning sheet.

When the cleaning sheet is taken up in this state, there is a problem that the toner or the like sticking to the cleaning sheet rubs the surface of the heating member in a contact portion between the cleaning sheet and the heating member, and the surface of a heating roller wears by friction. Therefore, the life of the heating member shortens, and it is difficult to maintain performance of the heating member for a long period of time.

BRIEF SUMMARY OF THE INVENTION

According to an aspect of the present invention, there is provided a fixing apparatus comprising:

a heating member which is formed into a cylindrical shape and whose outer peripheral surface is heated at a predetermined temperature;

a pressurizing member which contacts the heating member under a predetermined pressure;

a cleaning sheet which cleans the heating member;

a first take-up shaft which supports one end of the cleaning sheet on an upstream side of the heating member in a rotation direction;

a second take-up shaft which supports the other end of the cleaning sheet on a downstream side of the heating member in the rotation direction; and a pressing member which presses the cleaning sheet against the heating member in such a manner that a load applied on the downstream side is smaller than that applied on the upstream side of the heating member in the rotation direction.

According to another aspect of the present invention, there is provided a fixing apparatus comprising:

a heating member which is formed into a cylindrical shape and whose outer peripheral surface is heated at a predetermined temperature;

a pressurizing member which contacts the heating member under a predetermined pressure;

a cleaning sheet which cleans the heating member;

a first take-up shaft which supports one end of the cleaning sheet on an upstream side of the heating member in a rotation direction;

a second take-up shaft which supports the other end of the cleaning sheet on a downstream side of the heating member in the rotation direction; and a pressing member which presses the cleaning sheet against the heating member in such a manner that a load applied on the downstream side is smaller than that applied on the upstream side of the heating member in the rotation direction, wherein an angle formed by the cleaning sheet with respect to a tangent of the heating member in a position where the cleaning sheet contacts the heating member is large on the upstream side of the heating member in the rotation direction as compared with the angle on the downstream side.

Additional aspects and advantages of the invention will be set forth in the description which follows, and in part will be obvious from the description, or may be learned by practice of the invention. The aspects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described hereinafter in detail with reference to the drawings.

FIRST EMBODIMENT

Figure 1:
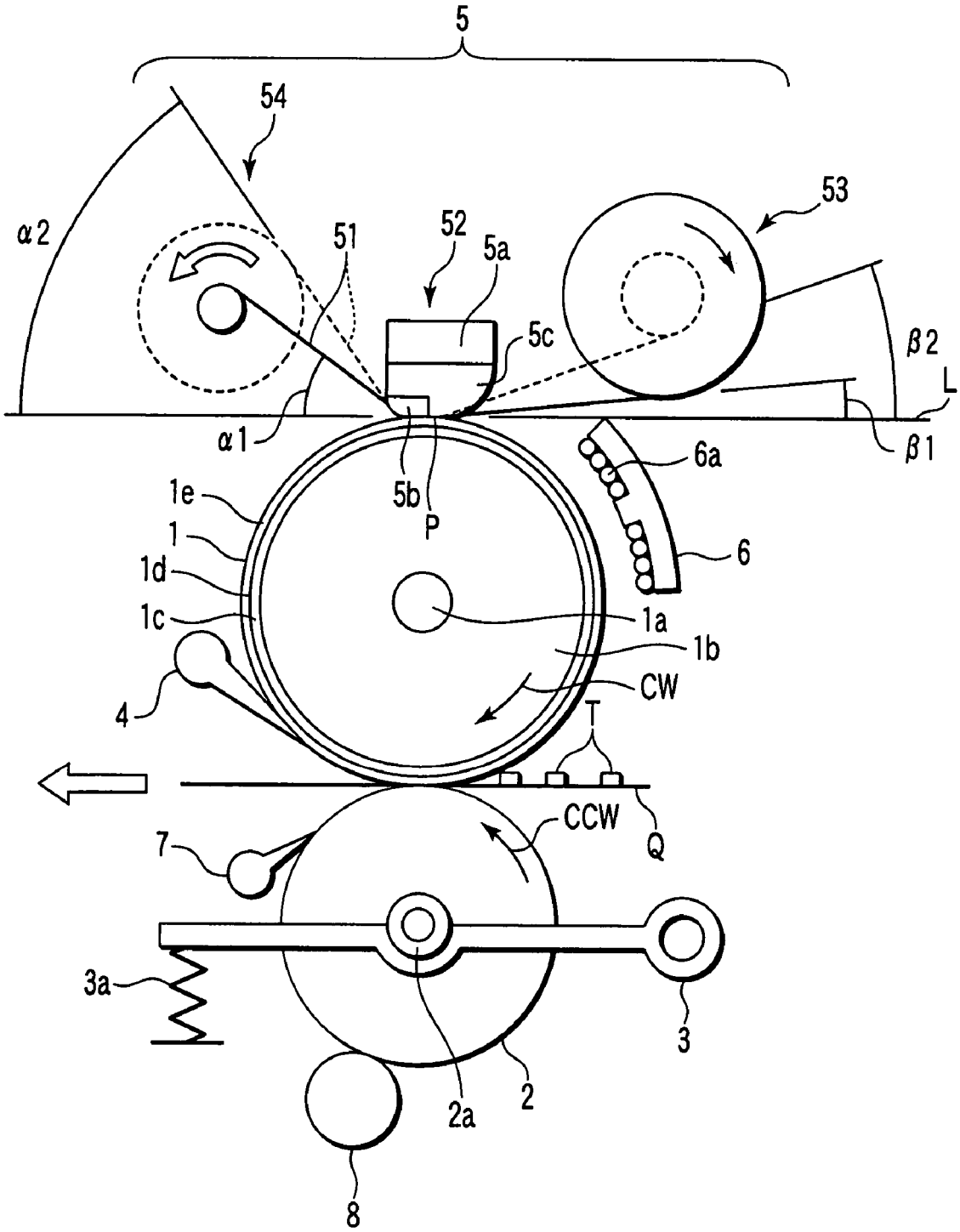
FIG. 1 is a schematic diagram showing one example of a fixing apparatus according to the present invention.

FIG. 1 shows one example of a fixing apparatus of the present invention.

As shown in FIG. 1, the fixing apparatus is capable of contacting the surface of a transfer material, that is, a sheet Q to which toner T sticks, and includes a heating member (heating roller) 1 which heats the toner T and the sheet Q, and a pressurizing member (pressurizing roller) 2 which applies a predetermined pressure to the heating roller 1.

The pressurizing roller 2 receives a predetermined pressure from a pressurizing mechanism 3 pressurized by a pressurizing spring 3*a* via a central shaft 2*a*. Accordingly, the pressurizing roller 2 is brought into contact with the heating roller 1, and a certain width (nip width) is formed in a contact portion (nip portion) between both the rollers in a conveying direction of the sheet Q.

The heating roller 1 has a core material 1*a*, an elastic member 1*b* positioned around the core material, a metal conductive layer 1*c*, a primer layer 1*d*, and a mold releasing layer 1*e*, and is rotated in an arrow CW direction by a driving motor (not shown). With the rotation of the heating roller 1, the pressurizing roller 2 is rotated in an arrow CCW direction.

In the present embodiment, the metal conductive layer 1*c* is formed of aluminum, iron or the like having a thickness of about 0.5 to 2 mm. The primer layer 1*d* is formed into a thickness of several micrometers, and has a function of enhancing adhesion strength between the metal conductive layer 1*c* and the mold releasing layer. The mold releasing layer 1*e* is formed into a thickness of about 10 μm on an outermost peripheral portion, and formed of a fluorocarbon resin (PFA, polytetrafluoroethylene (PTFE), or mixture of PFA and PTFE).

Around the heating roller 1, a peeling blade 4 for peeling the sheet Q from the heating roller 1, a cleaning device 5 for removing toner, paper powder or the like sticking to the heating roller 1, and an induction heating device 6 for supplying a predetermined magnetic field to the metal conductive layer 1*c* of the heating roller 1 are arranged in order of a rotation direction from the nip portion between the heating roller 1 and the pressurizing roller 2.

Around the pressurizing roller 2, a peeling blade 7 for peeling the sheet Q from the pressurizing roller 2, and a cleaning member 8 for removing the toner sticking to the pressurizing roller 2 are arranged.

When a high-frequency current is supplied to the induction heating device 6 from an exciting circuit (inverter circuit) (not shown), a predetermined magnetic field is produced from an exciting coil 6*a* of the induction heating device 6. By this magnetic field, an eddy current flows through the metal conductive layer 1*c* of the heating roller 1, and the heating roller 1 generates heat by Joule heat generated in accordance with resistance of the metal conductive layer 1*c*.

Toner T molten by the heat from the heating roller 1 is fixed to the sheet Q, when the sheet Q having the toner T attached thereto passes through a contact position (nip portion) between the heating roller 1 and the pressurizing roller 2, and a predetermined pressure is applied by the pressurizing roller 2.

Next, the cleaning device 5 will be described in more detail.

The cleaning device 5 includes a cleaning web (cleaning sheet) 51, a web pressing member 52, a first take-up shaft 53, and a second take-up shaft 54.

The cleaning web 51 contains silicon oil, and is pressed against the information surface of the heating roller 1 by the web pressing member 52. The toner, paper powder and the like sticking to the surface of the heating roller 1 are attached to the cleaning web to thereby clean the surface of the heating roller 1.

The web pressing member 52 includes, for example, a substrate 5*a* formed of a metal or the like, and first and second elastic portions 5*b* and 5*c* disposed on the side of the substrate 5*a* facing the heating roller 1. The member is fixed in a state in which the member is pressed against the surface of the heating roller 1 via the cleaning web 51 with a predetermined bite amount.

The first and second elastic portions 5*b* and 5*c* have resistance to heat, and the first elastic portion 5*b* is formed of a material (having large hardness) which is harder than that of the second elastic portion 5*c*. For example, the first elastic portion 5*b* is formed of solid silicon, fluorine rubber or the like, and the second elastic portion 5*c* is constituted of sponge rubber formed of silicon. In the present embodiment, the hardness (first hardness) of the first elastic portion 5*b* is 35 degrees by measurement of durometer ASKAR-C type or E type, and the hardness (second hardness) of the second elastic portion 5*c* is 20 degrees by measurement of durometer ASKAR-C type or E type. This will be described later in more detail with reference to FIG. 2.

An unused cleaning web 51 is wound around the first take-up shaft 53, and the shaft is disposed in a predetermined position of the fixing apparatus in such a manner as to be rotatable in an arrow direction (clockwise). That is, in a state (initial state) in which the cleaning web 51 is sufficiently wound as shown by a solid line, the first take-up shaft 53 is fixed in a position where an angle (hereinafter referred to as a web angle) formed by a tangent L of the heating roller 1 and the cleaning web 51 in a web pressing position P is β1.

On the other hand, the second take-up shaft 54 is rotated in an arrow direction (counterclockwise) by a driving motor (not shown), and takes up the used dirty cleaning web 51. Moreover, the second take-up shaft 54 is fixed in a position where a web angle is angle α1 which is larger than angle β1 in an initial state shown by a solid line.

When the passing of the predetermined number of sheets ends, the second take-up shaft 54 takes up a predetermined amount of the used cleaning web 51, and the unused cleaning web 51 wound around the take-up web 53 is successively supplied to the nip portion P between the heating roller 1 and the web pressing member 52 from the downstream side of the heating roller 1 in the rotation direction. In the present embodiment, in a situation in which a sheet having a usual image (image having a printing ratio of less than 20%) fixed thereto is passed, a control is adopted to move the cleaning web 51 by 0.3 mm every time eight A4-size sheets are passed. It is to be noted that outer periphery of the second take-up shaft 54 enlarges as an amount of the taken-up cleaning web 51 increases. Therefore, as to the driving motor (not shown), a rotation time is corrected in accordance with the number of passed sheets, and the second take-up shaft 54 is rotated at a rotation angle in accordance with the size of the outer periphery of the taken-up cleaning web 51. Accordingly, the cleaning web 51 is taken up by each certain amount.

When life end (e.g., end of printing of about 600,000 sheets) is counted by a life counter (not shown) mounted on the fixing apparatus, the fixing apparatus is required to be replaced. Therefore, the cleaning device 5 needs to have a life end which is set to be longer than that of at least the pressurizing roller 2, and the life end of the cleaning device 5 is more preferably provided with allowance. This prevents an operation of the fixing apparatus from being stopped immediately after the cleaning web 51 reaches the life end. In the present embodiment, the cleaning web 51 has a thickness of 40 μm and a length of 40 m.

As described above, (1) the cleaning web 51 pressed against the surface of the heating roller 1 by the web pressing member 52 is disposed in a position where a web angle α1 on the upstream side of the heating roller 1 in the rotation direction is larger than a web angle β1 on the downstream side in the rotation direction. Moreover, (2) the hardness of the web pressing member 52 on the upstream side is higher than that on the downstream side in the rotation direction, and therefore a load of the web pressing member 52 applied to the contact portion (nip portion) between the cleaning web 51 and the heating roller 1 increases on the upstream side rather than the downstream side. Therefore, the toner or the like sticking to the heating roller 1 is removed to some degree in an entrance (upstream side) of the nip portion between the cleaning web 51 and the heating roller 1. Therefore, the nip portion between the cleaning web 51 and the heating roller 1 can be prevented from being invaded by the toner or the like sticking to the heating roller 1 as such, and the toner or the like sticking to the nip portion of the cleaning web 51 with respect to the heating roller 1 can be reduced. Therefore, by movement of the cleaning web 51 taken up by the second take-up shaft 54, or the rotation of the heating roller 1, wear amount (shaved amount) of the surface of the heating roller 1 by rubbing of the toner or the like sticking to the cleaning web 51 with respect to the surface of the heating roller 1. Therefore, the life of the heating roller 1 can be extended.

Moreover, both the web angles α and β constantly increase from the beginning of the use of the web till an empty state in which there is not any cleaning web 51 on the first take-up shaft 53. Therefore, the cleaning device 5 of the present invention can maintain a relation "web angle α on the upstream side of the heating roller 1 in the rotation direction>web angle β on the downstream side" from an initial state till an end state.

It is to be noted that in the present embodiment, when the web angle α on the upstream side is 30 degrees or more, invasion of the removed toner or the like into the nip portion between the heating roller 1 and the web pressing member 52 is effectively inhibited, and wear on the heating roller 1 by the toner or the like can be satisfactorily prevented. Therefore, the web angle α1 in at least the initial state is preferably 30 degrees or more.

Next, a hardness difference between the first and second elastic portions 5*b* and 5*c* will be described with reference to FIG. 2.

Figure 2:
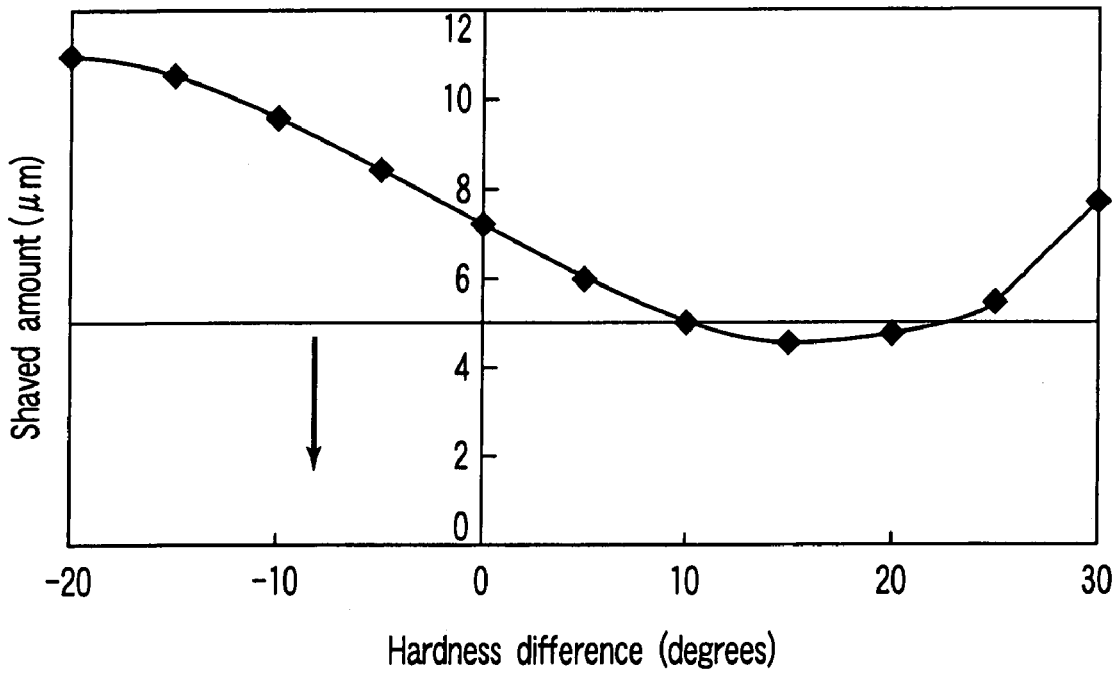
FIG. 2 is a diagram showing a relation of a hardness difference of first and second elastic portions of a pressing member usable in the fixing apparatus shown in FIG. 1 with respect to a shaved amount of a heating roller.

FIG. 2 shows a relation between the measured wear amount (shaved amount) of the surface of the heating roller 1, and the hardness difference of the first and second elastic portions 5*b* and 5*c* after executing printing of about 600,000 sheets in the fixing apparatus shown in FIG. 1. The abscissa indicates a hardness difference (hardness of the first elastic portion 5*b*-hardness of the second elastic portion 5*c*) from the first elastic portion 5*b* at a time when the hardness of the second elastic portion 5*c* is set to 20 degrees by the measurement of durometer ASKAR C or E type, and the ordinate indicates the shaved amount (unit: μm) of the heating roller 1, that is, a film thickness obtained by shaving the mold releasing layer 1*e* which is the outermost peripheral portion of the heating roller 1.

As shown in FIG. 2, when the hardness of the first elastic portion 5*b* is smaller than that of the second elastic portion 5*c* (the hardness difference of the abscissa is 0 or less), the shaved amount of roller 1 is 7 μm or more. When the hardness difference is between 10 and 20 degrees, the shaved amount of roller 1 is 5 μm or less. When the hardness difference is 15 degrees, the shaved amount of roller 1 is the smallest.

Additionally, when the shaved amount of the heating roller 1 utilized in the present embodiment is larger than 5 μm, the film thickness of the mold releasing layer 1*e* formed of a fluorine-based resin is not sufficiently secured, and therefore the lower primer layer 1*d* or metal conductive layer 1*c* is sometimes exposed. Since the surface becomes rough, and offset toner or the like easily sticks, a function of the mold releasing layer 1*e* is lost, and the life end results.

Therefore, in the present embodiment, to match the life end of the cleaning device 5 with that (the number of the passed sheets is about 60) of the heating roller 1, the hardness difference between the first and second elastic portions 5*b* and 5*c* of the present invention needs to be in a range of 10 to 20 degrees. On conditions on which the shaved amount shown in FIG. 2 becomes smallest, that is, in a constitution in which the second elastic portion 5*c* is set to 20 degrees and the first elastic portion 5*b* is set to 35 degrees by materials, wear on the heating roller 1 can be reduced, and the life of the heating roller 1 can be extended. In the present embodiment, considering this, the web pressing member 52 is used including the first and second elastic portions 5*b* and 5*c* having hardness described with reference to FIG. 1.

It has been described in the fixing apparatus of the present embodiment that the life end is counted by the life counter, but the present invention is not limited to this. For example, a pressurizing plate (not shown) may be used which applies a pressure to outer periphery of the take-up web 53 and applies a predetermined tension to the unwound/released cleaning web 51. That is, the apparatus may be constituted in such a manner as to detect an empty state of the cleaning web 51 wound around the take-up web 53, when detecting the position of the pressurizing plate, which changes with the unwinding of the cleaning web 51 from the take-up web 53.

Moreover, as described above in the present embodiment, according to the present invention, when the disposed positions of the first and second take-up shafts 53, 54 are adjusted, a web angle (α1, α2) of the second take-up shaft 54 can be set to be larger than a web angle (β1, β2) of the first take-up shaft 53. However, the present invention is not limited to this. For example, when a portion of the web pressing member 52 contacting the cleaning web 51 is formed into a polygonal shape, the web angle may be adjusted.

Figure 3:
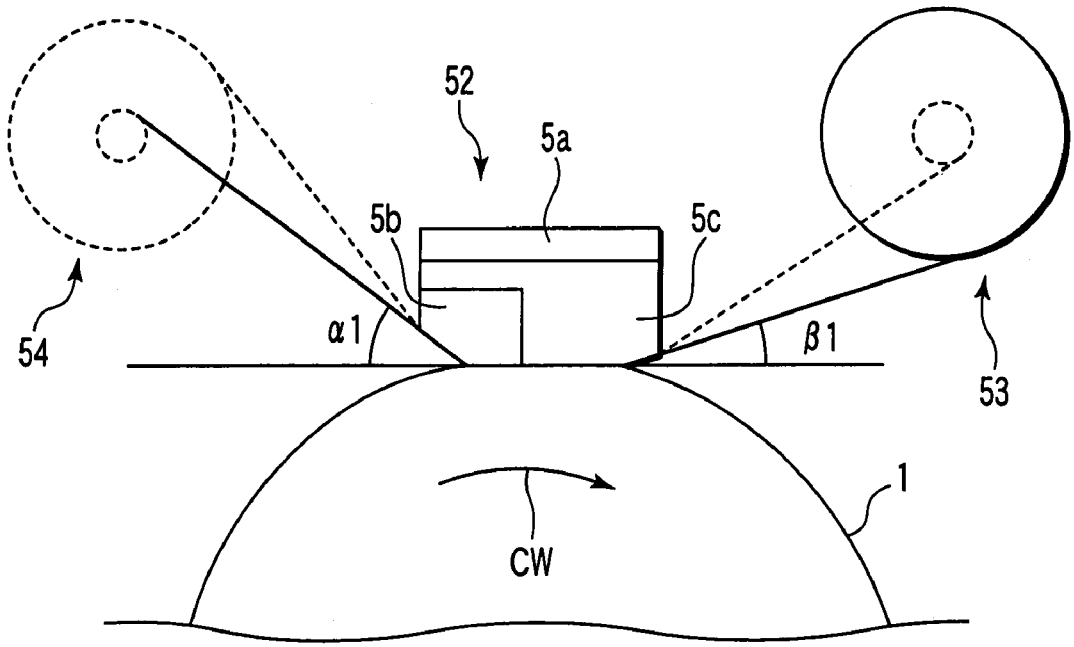
FIG. 3 is a schematic diagram showing another example of the pressing member usable in the fixing apparatus shown in FIG. 1.

That is, as shown in FIG. 3, the first elastic portion 5*b* contacting the heating roller 1 on the upstream side in the rotation direction is cut out into an angle α1, and the second elastic portion 5*c* contacting the heating roller 1 on the downstream side in the rotation direction is cut into an angle β1. The cleaning web 51 wound around the first take-up shaft 53 decreases, an outer diameter of the first take-up shaft 53 changes, the used cleaning web 51 is wound around the second take-up shaft 54, and the outer periphery of the second take-up shaft 54 changes as shown by a dotted line. Even in this case, the web angle of the cleaning web 51 does not change, the web angle of the heating roller 1 on the upstream side in the rotation direction is maintained at α1, and the web angle on the downstream side in the rotation direction is maintained at β1.

Moreover, a cleaning member 10 which cleans the pressurizing roller 2 shown in FIG. 1 may have the same constitution as that of the above-described cleaning device 5.

SECOND EMBODIMENT

Next, another embodiment of a fixing apparatus of the present invention will be described with reference to FIGS. 4 and 5.

Figure 4:
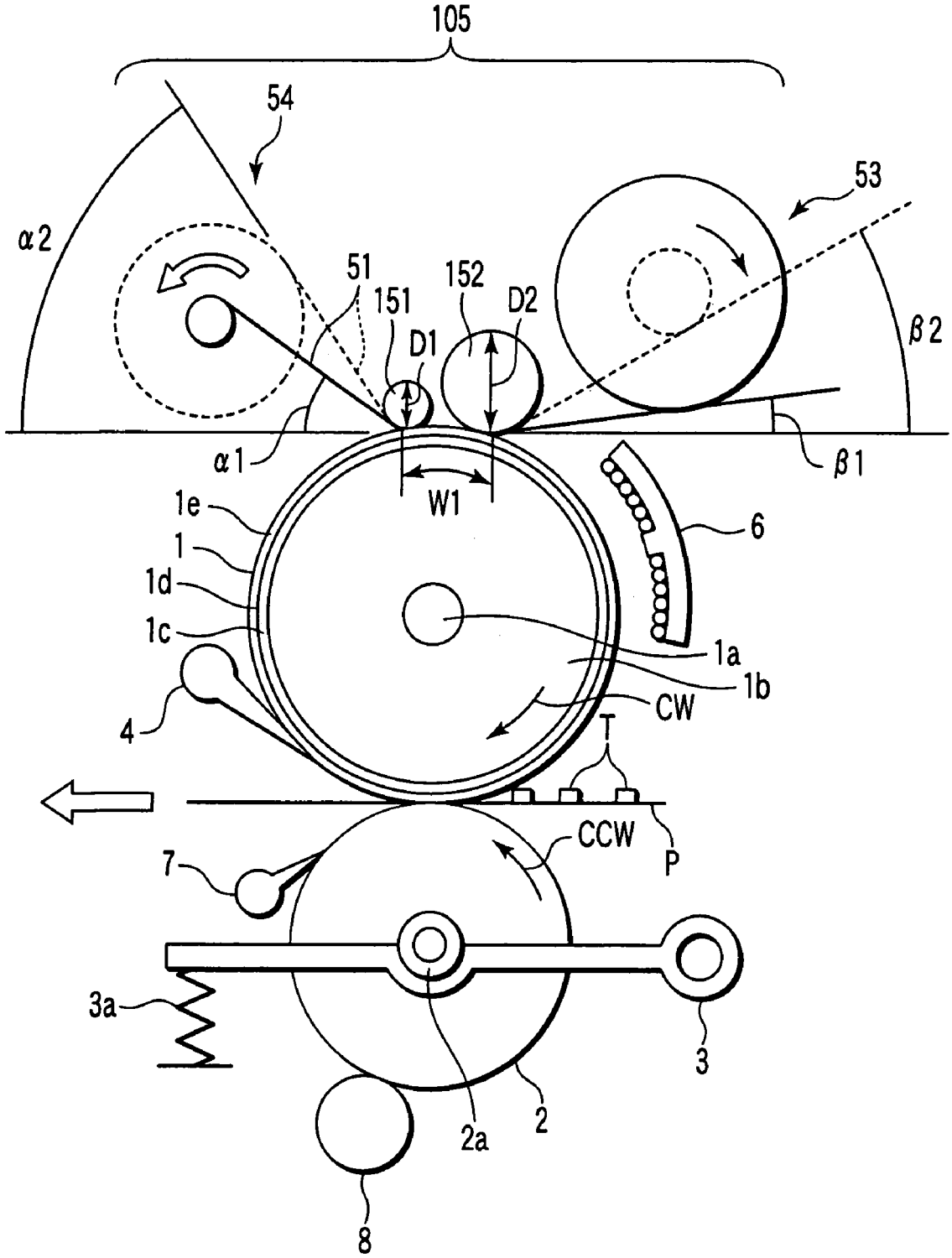
FIG. 4 is a schematic diagram showing another example of the fixing apparatus shown in FIG. 1.

FIG. 4 shows the fixing apparatus according to a second embodiment. It is to be noted that constituting elements having the same constitutions as those of FIG. 1 are denoted with the same reference numerals, and detailed description thereof is omitted.

As shown in FIG. 4, a cleaning device 105 includes a cleaning web 51, a first take-up shaft 53, a second take-up shaft 54, and first and second roller members 151, 152 which press the cleaning web 51 against the surface of the heating roller 1 with an equal bite amount.

The first roller member 151 is rotatably disposed on the nip upstream side of the heating roller 1 and cleaning web 51, and presses the cleaning web 51 taken up by the second take-up shaft 54 against the heating roller 1.

The second roller member 152 is rotatably disposed on the nip downstream side of the heating roller 1 and cleaning web 51, and presses the cleaning web 51 unwound from the first take-up shaft 53 against the heating roller 1.

The first and second roller members 151, 152 rotate with the movement of the cleaning web 51, when the cleaning web 51 is wound up by the second take-up shaft 54.

The cleaning web 51 is pressed against the heating roller 1 by the first and second roller members 151, 152 to thereby clean the surface of the heating roller 1. It is to be noted that a contact region (web nip width) W1 of the cleaning web 51 pressed by the first and second roller members 151, 152 to contact the heating roller 1 is determined by a distance between the first roller member 151 and the second roller member 152. Therefore, the first and second roller members 151, 152 are disposed in positions where predetermined nip is secured.

(1) The first roller member 151 has a diameter D1 which is smaller than a diameter D2 of the second roller member 152. Accordingly, in the cleaning web 51, the web angle $\alpha 1$ of the heating roller 1 on the upstream side in the rotation direction is set to be larger than the web angle $\beta 1$ on the downstream side in the initial state shown by a solid line in FIG. 4. Then, the web angle $\alpha 2$ of the heating roller 1 on the upstream side in the rotation direction is maintained to be larger than the web angle $\beta 2$ on the downstream side even in the end state shown by a dotted line in FIG. 4. That is, the relation of "the web angle $\alpha$ of the heating roller 1 on the upstream side of the rotation direction > the web angle $\beta$ on the downstream side" can be maintained from the initial state till the end state.

(2) Moreover, the load applied to the heating roller 1 on the downstream side in the rotation direction is smaller than the load applied on the upstream side in the nip portion between the cleaning web 51 and the heating roller 1. Therefore, the following first to third examples can be applied, but the first example is used in the present embodiment.

FIRST EXAMPLE

For example, as to first and second roller members 151, 152, elastic materials having resistance to heat are formed around a core material, and the members have equal hardness (e.g., 20 degrees in measurement by a durometer ASKAR C or E type). Moreover, as described above, the first and second roller members 151, 152 are pressed against the surface of the heating roller 1 via the cleaning web 51 with an equal bite amount (0.5 to 1.5 mm). Therefore, since the first and second roller members 151, 152 have different diameters, nip widths of the rollers 151, 152, and heating roller 1 also differ. That is, the nip width of the first roller member 151 and the heating roller 1 is smaller than that of the second roller member 152 and the heating roller 1, and a load per unit area is larger. Therefore, a large load is applied to a web nip portion between the cleaning web 51 and the heating roller 1 on the upstream side as compared with the downstream side.

SECOND EXAMPLE

For example, as to first and second roller members 151, 152, elastic materials having resistance to heat are formed around a core material, and the members have equal hardness. Moreover, the first and second roller members 151, 152 are pressed against the surface of the heating roller 1 via the cleaning web 51 with different bite amounts. That is, a pressurizing force of the first roller member 151 is larger than that of the second roller member 152. In the present embodiment, the pressurizing force depends on the bite amount. For example, assuming that a diameter of the heating roller 1 is r1, a diameter of the first roller member 151 is D1, and a distance between axial centers of the heating roller 1 and the first roller member 151 in a pressed state is d, the bite amount obtained by r1+D1−d is set to be larger than a similarly obtained bite amount of the second roller member 152. Accordingly, a larger load is applied to the web nip portion between the cleaning web 51 and the heating roller 1 on the upstream side rather than the downstream side.

THIRD EXAMPLE

For example, as to first and second roller members 151, 152, elastic materials having resistance to heat are formed around a core material, and the first roller member 151 is formed of a material harder (having higher hardness) than that of the second roller member 152. Moreover, the first and second roller members 151, 152 are pressed against the surface of the heating roller 1 via the cleaning web 51 with an equal bite amount.

The first roller member 151 is formed of, for example, solid silicon, fluorine rubber or the like, and the second roller member 152 is formed of sponge rubber comprising silicon. Therefore, a load applied per unit area of a heating roller 1 from the first roller member 151 is larger than that from the second roller member 152. Therefore, a larger load is applied to the web nip portion between the cleaning web 51 and the heating roller 1 on the upstream side rather than the downstream side.

As described above, (1) the cleaning web 51 pressed against the surface of the heating roller 1 by the first and second roller members 151, 152 is disposed in a position where the web angle $\alpha$ of the heating roller 1 on the upstream side in the rotation direction is larger than the web angle $\beta$ on the downstream side in the rotation direction. Moreover, (2) the load applied to a contact portion (nip portion) between the cleaning web 51 and the heating roller 1 on the upstream side is larger than that on the downstream side. Therefore, the toner or the like sticking to the heating roller 1 is removed to some degree in an entrance (upstream side) of the nip portion between the cleaning web 51 and the heating roller 1. Therefore, the nip portion between the cleaning web 51 and the heating roller 1 can be prevented from being invaded by the toner or the like sticking to the heating roller 1 as such, and the toner or the like sticking to the nip portion of the cleaning web 51 with the heating roller 1 can be reduced.

Next, a relation between the diameters of the first and second roller members 151, 152 will be described with reference to FIG. 5.

Figure 5:
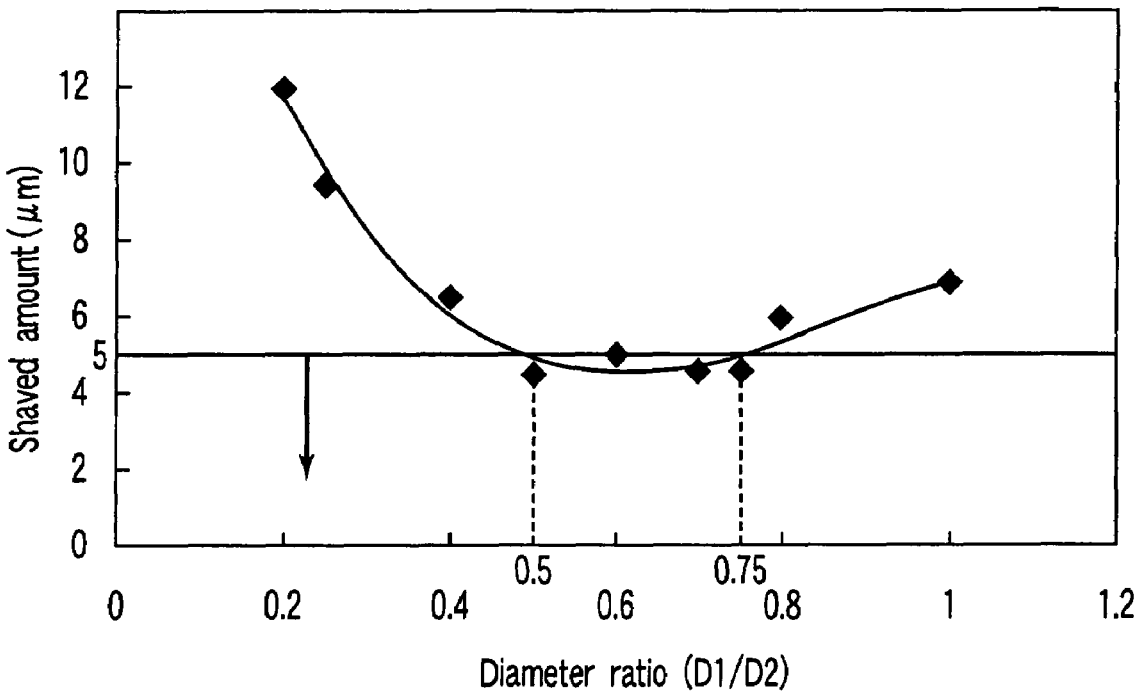
FIG. 5 is a diagram showing a relation of a diameter ratio of first and second roller members usable in the fixing apparatus shown in FIG. 4 with respect to the shaved amount of the heating roller.

FIG. 5 shows a relation between a measured wear amount (shaved amount) on the surface of the heating roller 1, diameter D1 of the first roller member 151, and diameter D2 of the second roller member 152 after executing printing of 600,000 sheets in the fixing apparatus shown in FIG. 4. The abscissa indicates a diameter ratio (D1/D2) of the first and second roller members 151, 152, and the ordinate indicates the shaved amount (unit: μm) of the heating roller 1, that is, film thickness obtained by shaving a mold releasing layer 1*e* which is an outermost peripheral portion of the heating roller 1.

As shown in FIG. 5, the shaved amount is 5 μm or less in a range of the diameter ratio (D1/D2) of "0.5≦D1/D2≦0.75". Additionally, as described with reference to FIG. 2, when the shaved amount is larger than 5 μm, the heating roller 1 utilized in the present embodiment loses a function of the mold releasing layer 1*e* disposed in the outermost peripheral portion, and reaches its life end.

Therefore, in the present embodiment, to match the life end of the cleaning device 5 with that (the number of the passed sheets is about 60) of the heating roller 1, the first and second roller members 151, 152 of the present invention is formed in a range of a diameter ratio of "0.5≦D1/D2≦0.75", wear on the heating roller 1 can further be prevented, and the life of the heating roller 1 can be extended.

Moreover, as described above, the first roller member 151 has a diameter D1 which is smaller than the diameter D2 of the second roller member 152. Therefore, when the diameter D2 of the second roller member 152 is reduced, the diameter D1 of the first roller member 151 becomes smaller, elasticity is lost, hardness becomes excessively large, and proceeding of the wear accelerates. When the diameter D1 of the first roller member 151 is excessively small, curvature is also small, the load applied per unit area increases in a concentrated manner, and the heating roller 1 is sometimes damaged. Therefore, in the present embodiment, the above-described problem can be avoided, when the diameter of the second roller member 152 is set to a range of 12 to 30 mm.

It is to be noted that the present invention is not limited to the above-described embodiments, and can be variously modified or changed in a range without departing from the scope in an implementation stage. The embodiments may be appropriately combined and carried out if possible. In this case, an effect by combination is obtained.

Moreover, the cleaning device 5 shown in FIG. 1 has both (1) the web angle α on the upstream side > web angle β on the downstream side and (2) the hardness of the first elastic member 5*b* of the web pressing member 52 on the upstream side > hardness of the second elastic member 5*c* on the downstream side. However, the present invention is not limited to this, if at least one of the conditions (1) and (2) is satisfied, the toner and the like can be removed to some degree in the entrance of the nip portion between the cleaning web 51 an dh heating roller 1. When both the conditions (1) and (2) are provided, a higher effect is expected.

For example, as described in the second embodiment, in the example in which the cleaning web 51 is pressed against the heating roller 1 using the first and second roller members 151, 152, the first and second take-up shafts 53, 54 are fixed to a position where the web angle α>web angle β is constantly established utilizing the first and second roller members 151, 152 having an equal diameter. Moreover, the hardness of the first roller member 151 is set to 35 degrees in the measurement of the durometer ASKAR C or E type, and the hardness (second hardness) of the second roller member 152 is set to 20 degrees in the measurement of the durometer ASKAR C or E type. Accordingly, the toner and the like sticking to the heating roller 1 are removed to some degree in the entrance (upstream side) of the nip portion of the cleaning web 51 and heating roller 1. The nip portion between the cleaning web 51 and the heating roller 1 can be prevented from being invaded by the toner or the like sticking to the heating roller 1 as such, and the wear amount (shaved amount) of the surface of the heating roller 1 by the rubbing of the toner and the like sticking to the nip portion of the cleaning web 51 with respect to the surface of the heating roller 1 can be reduced.

Moreover, when the first elastic portion 5*b* and second elastic portion 5*c* shown in FIG. 1, and the first and second roller members 151, 152 shown in FIG. 4 have excessively large hardness, the wear proceeds fast, and the hardness is preferably 50 degrees or less in the measurement of the durometer ASKAR C or E type.

What is claimed is:

1. A method of cleaning a fixing apparatus comprising a heating member which is formed into a cylindrical shape and having an outer peripheral surface heated at a predetermined temperature; and a pressurizing member which contacts the heating member under a predetermined pressure; the method comprising: supporting one end of a cleaning sheet on an upstream side of the heating member in a rotation direction of the heating member; supporting the other end of the cleaning sheet on a downstream side of the heating member in the rotation direction; and pressing the cleaning sheet against the heating member at positions apart from each other in the rotating direction in such a manner that a load applied on the cleaning sheet at a position on the downstream side is smaller than that applied on the cleaning sheet at the other position on the upstream side of the heating member in the rotation direction.

2. The method according to claim 1, wherein the pressing includes pressing the cleaning sheet against the heating member by a pressing member formed of an elastic material.

3. The method according to claim 2, wherein the elastic material comprises a first elastic portion which presses the cleaning sheet against the heating member on the upstream side of the heating member in the rotation direction, and a second elastic portion which presses the cleaning sheet on the downstream side of the heating member in the rotation direction from the first elastic portion; and the first and second elastic portions have different hardness.

4. The method according to claim 3, wherein the hardness of the first elastic portion is larger than that of the second elastic portion.

5. The method according to claim 4, wherein a difference between the hardness of the first elastic portion and that of the second elastic portion is in a range of 10 degrees to 20 degrees in measurement of a durometer ASKAR C or E type.

6. The method according to claim 1, wherein the pressing includes pressing the cleaning sheet against the heating member on the upstream side in the rotation direction by a first roller member; and pressing the cleaning sheet against the heating member on the downstream side in the rotation direction by a second roller member.

7. The method according to claim 6, wherein at least outer peripheral surfaces of the first and second roller members comprise elastic materials.

8. The method according to claim 7, wherein the hardness of the first roller member is larger than that of the second roller member.

9. The method according to claim 8, wherein a difference between the hardness of the first roller member and that of the second roller member is in a range of 10 degrees to 20 degrees in measurement of a durometer ASKAR C or E type.

10. A method of cleaning a fixing apparatus comprising a heating member which is formed into a cylindrical shape and having outer peripheral surface heated at a predetermined temperature; and a pressurizing member which contacts the heating member under a predetermined pressure; the method comprising: supporting one end of a cleaning sheet on an upstream side of the heating member in a rotation direction; supporting the other end of the cleaning sheet on a downstream side of the heating member in the rotation direction; pressing the cleaning sheet against the heating member at positions apart from each other in the rotating direction in such a manner that a load applied on the cleaning sheet at a position on the downstream side is smaller than that applied on the cleaning sheet at the other position on the upstream side of the heating member in the rotation direction; and keeping an angle formed by the cleaning sheet with respect to a tangent of the heating member in a position where the cleaning sheet contacts the heating member to be larger on the upstream side of the heating member in the rotation direction as compared with the angle on the downstream side.

11. The method according to claim 10, wherein the pressing includes pressing the cleaning sheet against the heating member by a pressing member formed of an elastic material.

12. The method according to claim 11, wherein the elastic material comprises: cutout portions on the upstream and downstream sides of the heating member in the rotation direction, and an angle formed by the tangent with the cutout portion on the upstream side is larger than that formed by the tangent with the cutout portion on the downstream side.

13. The method according to claim 11, wherein the elastic material comprises: a first elastic portion which presses the cleaning sheet against the heating member on the upstream side of the heating member in the rotation direction; and a second elastic portion which presses the cleaning sheet on the downstream side of the heating member in the rotation direction from the first elastic portion, and the first and second elastic portions have different hardness.

14. The method according to claim 13, wherein a difference between the hardness of the first elastic portion and that of the second elastic portion is in a range of 10 degrees to 20 degrees in measurement of a durometer ASKAR C or E type.

15. The method according to claim 10, wherein the pressing includes pressing the cleaning sheet against the heating member on the upstream side in the rotation direction by a first roller member; and pressing the cleaning sheet against the heating member on the downstream side in the rotation direction by a second roller member.

16. The method according to claim 15, wherein the first roller member has a diameter smaller than that of the second roller member.

17. The method according to claim 16, wherein assuming that the diameter of the first roller member is D1, and the diameter of the second roller member is D2, the diameters D1, D2 have ranges in which $0.5 \leqq D1/D2 \leqq 0.75$ is established.

18. The method according to claim 17, wherein at least outer peripheral surfaces of the first and second roller members comprise elastic materials.

19. The method according to claim 18, wherein the hardness of the first roller member is larger than that of the second roller member.

20. The method according to claim 19, wherein a difference between the hardness of the first roller member and that of the second roller member is in a range of 10 degrees to 20 degrees in measurement of a durometer ASKAR C or E type.

21. The method according to claim 16, wherein a load per unit area applied to the heating member by the first roller member is larger than that applied to the heating member by the second roller member.

* * * * *